US006706678B2

(12) United States Patent
Bargaje et al.

(10) Patent No.: US 6,706,678 B2
(45) **Date of Patent: *Mar. 16, 2004**

(54) NON-TOXIC CLEANING COMPOSITION

(75) Inventors: Vijaya Milind Bargaje, Bangalore (IN); Vidur Behal, Mumbai (IN); Kavitha Dhandapani, Bangalore (IN); Glyn Roberts, Bangalore (IN)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/268,497

(22) Filed: Oct. 10, 2002

(65) Prior Publication Data

US 2003/0078181 A1 Apr. 24, 2003

(30) Foreign Application Priority Data

Oct. 12, 2001 (IN) ..... 999/MUM/01

(51) Int. Cl.[7] ..... C11D 3/44

(52) U.S. Cl. ..... 510/407; 510/417; 510/365; 510/376

(58) Field of Search ..... 510/417, 505, 510/515, 376, 360, 506, 312, 516, 407; 8/137

(56) References Cited

U.S. PATENT DOCUMENTS

| | | | | |
|---|---|---|---|---|
| 4,176,080 A | * | 11/1979 | Wise et al. | 8/137 |
| 5,112,358 A | | 5/1992 | Deal, III | |
| 5,256,318 A | * | 10/1993 | Masutani et al. | 252/8.57 |
| 5,648,327 A | * | 7/1997 | Smerznak et al. | 510/340 |
| 5,962,391 A | | 10/1999 | Oldenhove et al. | |
| 6,224,851 B1 | * | 5/2001 | Bara | 424/59 |

FOREIGN PATENT DOCUMENTS

| | | | |
|---|---|---|---|
| DE | 19945505 | A1 | 4/2001 |
| EP | 0620270 | A2 | 10/1994 |
| GB | 922270 | | 3/1963 |
| GB | 1545188 | | 5/1979 |
| GB | 2173508 | A | 10/1986 |
| WO | 00/36206 | | 6/2000 |
| WO | 01/90474 | A1 | 11/2001 |

OTHER PUBLICATIONS

International Search Report Application No. PCT/EP 02/10675 mailed Nov. 20, 2002.

* cited by examiner

*Primary Examiner*—Gregory Webb
(74) *Attorney, Agent, or Firm*—Ronald A. Koatz

(57) ABSTRACT

The invention relates to a cleaning composition comprising an immiscible liquid system having at least one liquid—liquid interface with an interfacial tension greater than 5 mN/m. The less polar solvent in the system has a carbon chain length of at least 4, preferably greater than 6, or is a silicone with more than 3 SiO units. Typical examples of suitable less polar solvents are hydrocarbons, fluoroethers, polydimethylsiloxanes and fatty acid methyl esters. The more polar liquid in the system is preferably water. The composition is particularly suitable for cleaning soiled fabric, especially to remove particulate soil therefrom.

17 Claims, No Drawings

NON-TOXIC CLEANING COMPOSITION

TECHNICAL FIELD

The invention relates to a cleaning/washing composition comprising a non-toxic and safe system of immiscible liquids with high interfacial tension which does not require the use of additional detergency benefit agents, and to an improved process/method of cleaning/washing fabric using the same.

BACKGROUND AND PRIOR ART

Conventionally, fabric is cleaned using water and a detergent surfactant system which is known as wet cleaning. Surfactants adsorb on both fabric and soil and thereby reduce the respective interfacial energies and this facilitates removal of soil from the fabric. Alternatively, it is done by a process called dry cleaning where in organic solvents such as perchloroethylene (PCE), petroleum based or Stoddard solvents, chlorofluorocarbon (CFC)-113 and 1,1,1-trichloroethane are used, all of which are generally aided by a surfactant. The organic solvent helps in the removal of oily soil in the presence of detergents. Soil removal can be achieved by a small reduction in interfacial tension. The particulate soil is largely removed by providing agitation.

The organic solvents used for cleaning are generally toxic and also pose a problem as they are inflammable, creating potential fire hazards. Another major concern in solvent cleaning is the tendency of vapour loss from the cleaning system into the atmosphere especially when they are used at elevated temperatures. Solvent cleaning processes generally employ chlorinated solvents that are linked to ozone depletion. Several attempts have been made to avoid these problems and to find suitable substitutes.

WO-A-0036206 (3M) discloses dry cleaning compositions comprising hydrofluoroethers along with other co-solvents, and water present in an amount of less than 1% by weight of the composition. Hydrofluoroethers are relatively safe and less aggressive towards fabric.

U.S. Pat. No. 6,228,826 (MiCell Tech. Inc.,), discloses the use of end-functionalized polysiloxane surfactants to enhance the dry-cleaning aspects of carbon dioxide which was earlier considered as an alternative to the potentially toxic halocarbon solvents.

Regardless of the type of solvent used, which may be water or organic, agitation of garments in the cleaning medium is essential to accelerate the removal of the soluble soil or the insoluble, particulate soil. During dry cleaning when a surfactant is used, a maximum of about 10% of water is also used along with the solvent system in order to facilitate the removal of water soluble stains.

Our earlier-filed co-pending application WO-A-01/90474, published on Nov. 29, 2001, discloses a process of cleaning fabric using the liquid—liquid interface of at least two immiscible liquid phases with an interfacial tension greater than 5 mN/m, under agitation. Even in this method of cleaning the solvents used could be toxic, inflammable and have an impact on the environment.

SUMMARY OF THE INVENTION

It has now been found that if in the above-mentioned immiscible liquid phase the less polar solvent has a carbon chain length of at least 4 or is a silicone with more than 3 SiO units the above mentioned problems of toxicity, flammability, and environmental impact can be circumvented whilst retaining superior cleaning of fabric. The system comprising the immiscible liquid phase is superior to pure solvent cleaning in terms of the detergency benefit, especially for particulate soil. The carbon chain length should preferably be greater than 6.

BRIEF DESCRIPTION OF THE INVENTION

The applicants have found that efficient removal of both soluble and insoluble soils may be achieved by the cleaning of fabric under agitation using a washing/cleaning system comprising a liquid—liquid interface of at least two immiscible liquid phases with an interfacial tension greater than 5 mN/m, wherein the less polar solvent has a carbon chain length of at least 4, or is a silicone with more than 3 SiO units. It is also found that superior cleaning may be achieved economically by the use of water as a major component along with the organic solvent with the use of little or no surfactant contrary to prior art which teaches use of water at levels not exceeding 10% together with the use of surfactants.

The applicants have developed a system with at least one immiscible phase and with high interfacial tension which provides superior cleaning.

DETAILED DESCRIPTION OF THE INVENTION

Thus according to one aspect of the present invention there is provided a cleaning/washing composition comprising an immiscible liquid system having an interfacial tension greater than 5 mN/m wherein the less polar solvent has a carbon chain length of at least 4 or is a silicone with more than 3 SiO units.

Interfacial tension may be measured using various techniques, such as sessile drop, pendant drop, spinning drop, drop volume or Wilhelmy plate method. For the purposes of the present invention, interfacial tension is measured by the Wilhelmy plate method, using a Kruss Processor Tensiometer K12, at 25° C.

For some systems, the interfacial tension may change whilst undergoing shearing forces typically encountered in a wash process. It is customary to refer to the interfacial tension under these conditions as a "dynamic interfacial tension" (DIFT) and may be measured by a maximum bubble pressure technique.

According to a preferred aspect the cleaning/washing composition comprises an immiscible liquid system with an interfacial tension greater than 10 mN/m, wherein the less polar solvent has a carbon chain length of at least 4 or is a silicone with more than 3 SiO units and the concentration of the most polar liquid is 10–90% (v/v).

According to a more preferred aspect of the present invention the cleaning/washing composition comprises an immiscible liquid system with an interfacial tension greater than 20 mN/m wherein the less polar solvent has a carbon chain length of at least 4 or is a silicone with more than 3 SiO units and selectively provided such that the concentration of the most polar liquid is 40–90% (v/v) for a period of at least 5 minutes during the wash process.

It is preferred that the carbon chain length of the less polar solvent is greater than 6, particularly greater than 12 and more preferably greater than 16.

According to another aspect of the present invention there is provided a process of cleaning fabric comprising agitating the fabric in the above disclosed immiscible liquid system having an interfacial tension greater than 5 mN/m, wherein the less polar solvent has a carbon chain length of at least 4 or is a silicone with more than 3 SiO units.

Solvents

The less polar solvents that have a carbon chain length of at least 4, preferably greater than 6 may be selected from branched and linear alkanes (chemical formula CnH2n+2 where n is at least 4, preferably greater than 6), including but not limited to hexane, heptane, octane, nonane, decane, dodecance, tridecane, tetradecane, pentadecane etc. and mixtures thereof. Commercially available mixtures of this type include Isopar L (C11–C15 alkanes—ex Exxon) and DF2000 (C11–C15 iso-alkanes; CAS #90622-58-5, ex Exxon). They may also be selected from branched and linear alkenes with at least 4, preferably more than 6 carbon atoms including but not limited to octenes, nonenes, decenes, undecenes, dodecenes etc, with one or more double bonds, and mixtures thereof.

They may also be selected from ethers with at least 4 carbon atoms including fluoroethers such as methoxy nonafluorobutane HFE-7100(i.e. C4F9-OCH3) and ethoxy nonafluorobutane HFE-7200(i.e. C4F9-OC2H5); from esters with at least 4 carbon atoms, such as dibutyl phthalate, dioctyl phthalate, C8–C24 saturated and/or unsaturated fatty acid methyl esters; and terpenes such as limonene; and mixtures of the above.

C8–C24 saturated and/or unsaturated fatty acid methyl esters are particularly preferred esters as less polar solvents, and typical examples thereof are C10–C18 fatty acid methyl esters such as methyl laurate, methyl myristate, methyl stearate, methyl linoleate, methyl linolenate and mixtures thereof.

The less polar solvents with more than 3 SiO units may be selected from polydimethyl siloxane oils. Linear and cyclic siloxanes known as Lx and Dx where x is greater than three are suitable for use in the invention. Specific examples include octamethylcyclotetrasiloxane (D4) (ex-Dow Corning), decamethylcyclopentasiloxane (D5), dodecamethylcyclohexasiloxane (D6), decamethyltetrasiloxane (L4) and dodecamethylpentasiloxane (L5).

The immiscible liquid system furthermore comprises at least one other, more polar solvent such that the liquid system has an interfacial tension greater than 5 mN/m. Such more polar solvent may be selected from water, alcohols, ketones, aromatic solvents, halogenated solvents, heterocyclic compounds; and hydrocarbons, paraffins, esters, and ethers with less than 4 carbon atoms. Preferably the more polar solvent is water.

OPTIONAL INGREDIENTS

It is possible to incorporate other conventional detergent ingredients such as surfactants, builders, anti-redeposition agents, soil release polymers, hydrotropes, enzymes, bleaches, fluorescers, perfumes etc. into the immiscible liquid system.

Agitation

Agitation can be provided by impellers that cover the vertical flow profile or radial flow profile or a combination of both so that thorough mixing of the immiscible liquids take place. Agitation can be provided by impellers that are open curved turbine, turbine type propeller, axial flow turbine, flat blade turbine, inverted vane turbine, marine propeller etc. This action may also be accompanied by a tumbling action. Optionally agitation can also be provided by a combination of rotation and tumbling action. Other forms of agitation using gas jets or ultra sound may also be employed. Other forms of agitation generally known in the art can also be employed provided it ensures a good mixing of the immiscible liquid phases.

The nature of the invention, its objects and advantages will be more apparent from the ensuing description made with relation to non-limiting exemplary examples of the above identified various aspects of the invention.

The invention will now be described in greater detail with reference to immiscible liquid compositions for cleaning fabric.

EXAMPLES

Example 1

Carbon soot N220, Carbot, (15 mg) was added to a 5 mg solution of sodium dodecyl sulphate in 100 ml of de-ionised water and the mixture dispersed evenly by sonication in an ultra-sound bath for a minimum of 1.5 hours. A swatch of plain white cotton fabric 10×10 cm (Poplin weave, ex Hindustan Spinning & Weaving Mills, Mumbai) was then dipped into this mixture by hand until the cotton was observed visibly to be wetted completely—(10–20)s. The swatch was then withdrawn from the suspension, allowed to drain naturally and air dry overnight. This process was repeated with a further 2 swatches. The resultant particulate soiled fabric was air dried overnight and initial reflectance at 460 nm (R460*), with contribution from ultra-violet radiation removed, was measured using a Macbeth Colour-eye 7000A reflectometer. The three swatches were placed into a 500 ml conical flask to which 300 ml of water+0.75 grams of detergent (Surf Excel ex-Hindustan Lever Ltd) had been added (2.5 grams per liter as per current consumer habit). The conical flask was agitated at 120 rpm for 30 mins at ambient temperature using a reciprocating agitator, which facilitates efficient mixing of the liquids. Following washing, the individual swatches were air-dried and the final reflectance values for the swatches at 460 nm with contribution from ultra-violet radiation removed, were determined. The change in reflectance ΔR is determined by subtracting the initial reflectance from the final reflectance and the average change in detergency, together with the standard deviation, is presented in Table 1.

Example 2

The procedure outlined in Example 1 was repeated but with the water+detergent wash medium replaced with 300 ml of methoxy nonafluorobutane (tradename HFE 7100, ex-3M). The average change in reflectance values for this system is reported in Table 1.

Example 3

The procedure outlined in Example 1 was repeated but with the water +detergent wash medium replaced with 300 ml synthetic aliphatic hydrocarbon (DF-2000, ex-3M). The average change in reflectance values for this system is reported in Table 1.

Example 4

The procedure outlined in Example 1 was repeated but with the water+detergent wash medium replaced with 60 ml of petroleum ether (from MERC chemicals)+240 ml of deionised water. The average change in reflectance values for this system is reported in Table 1.

Example 5

The procedure outlined in Example 1 was repeated but with the water+detergent wash medium replaced with 60 ml mixture of methoxy nonafluorobutane (tradename HFE 7100, ex-3M)+240 ml of deionised water. The average change in reflectance values for these system is reported in Table 1.

Example 6

The procedure outlined in Example 1 was repeated but with the water+detergent wash medium replaced with 60 ml mixture of synthetic aliphatic hydrocarbon (DF-2000, ex-Exxon; flash point>62° C.)+240 ml of deionised water. The average change in reflectance values for this system is reported in Table 1.

Example 7

The procedure outlined in Example 1 was repeated but with water+detergent wash medium replaced with 300 ml of Fatty Acid Methyl Ester CE1218 (a mixture of methyl laurate, methyl myristate & methyl stearate, ex-P&G, Malaysia, CAS #68937-84-8). The average change in reflectance values for this system is reported in Table 1.

Example 8

The procedure outlined in Example 1 was repeated but with water+detergent wash medium replaced with 300 ml of Fatty Acid Methyl Ester C2170 (a mixture of methyl laurate, & methyl myristate, ex P & G Malaysia, CAS #67762-40-7). The average change in reflectance values for this system is reported in Table 1.

Example 9

The procedure outlined in Example 1 was repeated but with water+detergent wash medium replaced with 300 ml of Soya methyl ester (a mainly $C_{18}$ unsaturated fatty acid methyl ester ex Columbus Foods, USA). The average change in reflectance values for this system is reported in Table 1.

Example 10

The procedure outlined in Example 1 was repeated but with water+detergent wash medium replaced with 300 ml of Palm methyl ester (a methyl laurate; tradename Exceparl ML85 ex-Kao, Japan). The average change in reflectance values for this system is reported in Table 1.

Example 11

The procedure outlined in Example 1 was repeated but with water+detergent wash medium replaced with 60 ml of Fatty Acid Methyl Ester CE1218 (a mixture of methyl laurate, methyl myristate & methyl stearate, ex-P &G, Malaysia, CAS #68937-84-8) and 240 ml of water. The average change in reflectance values for this system is reported in Table 1.

Example 12

The procedure outlined in Example 1 was repeated but with water+detergent wash medium replaced with 60 ml of Fatty Acid Methyl Ester C2170 (a mixture of methyl laurate, & methyl myristate, ex P & G Malaysia, CAS #67762-40-7) and 240 ml of water. The average change in reflectance values for this system is reported in Table 1.

Example 13

The procedure outlined in Example 1 was repeated but with water+detergent wash medium replaced with 60 ml of Soya methyl ester (a mainly $C_{18}$ unsaturated fatty acid methyl ester ex Columbus Foods, USA) and 240 ml of water. The average change in reflectance values for this system is reported in Table 1.

Example 14

The procedure outlined in Example 1 was repeated but with water+detergent wash medium replaced with 60 ml Palm methyl ester (a methyl laurate; tradename Exceparl ML85 ex-Kao, Japan) and 240 ml of water. The average change in reflectance values for this system is reported in Table 1.

| Example | Wash system | Detergency dR 460* | Std Dev |
|---|---|---|---|
| 1 | Surf Excel | 6 | 1.4 |
| 2 | HFE-7100 | 1 | 1 |
| 3 | DF-2000 | 1 | 1.2 |
| 4 | Petroleum ether (Inflammable):water 20:80 | 17.2 | 1 |
| 5 | Methoxy nonafluorobutane (HFE-7100):water 20:80 | 14.7 | 1.1 |
| 6 | Synthetic aliphatic hydrocarbon (DF-2000):water 20:80 | 15.2 | 1.3 |
| 7 | C12–C18-Methyl Esters | −10.5 | 0.6 |
| 8 | C10–C16-Methyl Esters | −7.2 | 0.5 |
| 9 | Soya methyl ester | −2.9 | 0.5 |
| 10 | Palm methyl ester | −12.5 | 1 |
| 11 | C12—C18-Methyl Esters:water 20:80 | 18.7 | 1 |
| 12 | C1O–C16-Methyl Esters:water 20:80 | 10.2 | 1 |
| 13 | Soya methyl ester:water 20:80 | 20.7 | 1 |
| 14 | Palm methyl ester:water 20:80 | 18.1 | 0.5 |

The use of water alone as control gave a AR460* of 4.5, Std. Dev. 1.1

The data presented in table 1 show that solvents like methoxy nonafluorobutane, synthetic aliphatic hydrocarbons and fatty acid methyl esters, that are safe, possess low flammability, low environmental toxicity, both in terms of biodegrability and ozone depletion potential, when used in combination with a high polar solvent such as water, gave a significantly higher detergency benefit in comparison to a regular detergent wash or the solvent alone. The benefit was comparable to the solvent water system consisting of petroleum ether and water where petroleum ether, however, has the disadvantage of being inflammable (flash point 13° C.). The combination of these solvents and water are capable of cleaning both particulate and oily soil from the fabric.

What is claimed is:

1. A cleaning composition comprising an immiscible liquid system comprising a polar solvent and a less polar solvent wherein a liquid—liquid interface between the polar solvent and the less polar solvent has an interfacial tension greater than 5 mN/m, and wherein said system is characterised in that the less polar solvent in the system has a carbon chain length of at least 4, or is a silicone with more than 3SiO units.

2. A composition according to claim 1, characterised in that the less polar solvent has a carbon chain length, greater than 6.

3. A composition according to claim 1, characterised in that the less polar solvent has a carbon chain length, greater than 12.

4. A composition according to claim 1, characterised in that the less polar solvent has a carbon chain length, greater than 16.

5. A composition according to claim 1, characterised in that the less polar solvent is a hydrocarbon.

6. A composition according to claim 5, characterised in that the less polar solvent is a $C_{11}$–$C_{15}$ hydrocarbon mixture.

7. A composition according to claim 1, characterised in that the less polar solvent is methoxy or ethoxy nonafluorobutane.

8. A composition according to claim 1, characterised in that the less polar solvent is a $C_8$–$C_{24}$ saturated or unsaturated fatty acid methyl ester.

9. A composition according to claim 8, characterised in that the less polar solvent is a $C_{10}$–$C_{18}$ saturated or unsaturated fatty acid methyl ester.

10. A composition according to claim 1, characterised in that the less polar solvent is a polydimethyl siloxane.

11. A composition according to claim 1, characterised in that the interfacial tension is greater than 10 mN/M.

12. A composition according to claim 1, characterised in that the interfacial tension is greater than 20 mN/m.

13. A composition according to claim 1, characterised in that the concentration of the more polar liquid ranges from 10–90% (v/v).

14. A composition according to claim 13, characterised in that the concentration of the more polar liquid ranges from 40–90% (v/v) for a period of at least 5 minutes when used in a cleaning process.

15. A composition according to claim 1, characterised in that the more polar liquid is water.

16. Use of a composition according to claim 1, in a fabric cleaning process to remove particulate soil.

17. A process for cleaning soiled fabric comprising treating the soiled fabric with a composition according to claim 1 under agitation.

* * * * *